US010220995B2

(12) United States Patent
Zacherle

(10) Patent No.: US 10,220,995 B2
(45) Date of Patent: Mar. 5, 2019

(54) BLISTER CARD WITH FLANGE STRAP

(71) Applicant: WestRock MWV, LLC, Norcross, GA (US)

(72) Inventor: Matthew E. Zacherle, Chesterfield, VA (US)

(73) Assignee: WestRock MWV, LLC, Atlanta, GA (US)

( * ) Notice: Subject to any disclaimer, the term of this patent is extended or adjusted under 35 U.S.C. 154(b) by 0 days.

(21) Appl. No.: 14/971,024

(22) Filed: Dec. 16, 2015

(65) Prior Publication Data

US 2016/0194130 A1 Jul. 7, 2016

Related U.S. Application Data

(60) Provisional application No. 62/100,587, filed on Jan. 7, 2015.

(51) Int. Cl.

| | |
|---|---|
| ***B65D 75/32*** | (2006.01) |
| ***B65B 11/00*** | (2006.01) |
| ***B65B 11/48*** | (2006.01) |
| ***B65D 73/00*** | (2006.01) |
| ***B65D 75/56*** | (2006.01) |
| *B65B 51/02* | (2006.01) |
| *B65B 51/10* | (2006.01) |

(52) U.S. Cl.

CPC ..... *B65D 75/321* (2013.01); *B65B 11/004* (2013.01); *B65B 11/48* (2013.01); *B65D 73/0085* (2013.01); *B65D 75/322* (2013.01); *B65D 75/563* (2013.01); *B65B 51/02* (2013.01); *B65B 51/10* (2013.01)

(58) Field of Classification Search

CPC . B65D 73/0085; B65D 75/321–75/322; B65D 75/563

USPC ..... 206/349, 461–477, 482–483, 486, 493; 229/87.05–87.06

See application file for complete search history.

(56) References Cited

U.S. PATENT DOCUMENTS

| | | | | |
|---|---|---|---|---|
| 4,165,805 A | | 8/1979 | Fethke et al. | |
| 4,714,159 A | * | 12/1987 | Linden | B65D 73/0057 206/349 |
| 4,872,551 A | | 10/1989 | Theros | |
| 5,234,106 A | * | 8/1993 | Transue | B65D 73/0021 206/349 |
| 5,279,417 A | | 1/1994 | Seaton | |
| 5,284,244 A | * | 2/1994 | O'Toole | B65D 25/10 206/363 |

(Continued)

FOREIGN PATENT DOCUMENTS

| | | |
|---|---|---|
| WO | WO2012012015 A1 | 1/2012 |
| WO | WO2012067757 A1 | 5/2012 |
| WO | WO2012094467 A1 | 7/2012 |

*Primary Examiner* — Chun Cheung
*Assistant Examiner* — Brijesh V. Patel
(74) *Attorney, Agent, or Firm* — WestRock Intellectual Property Group

(57) ABSTRACT

A sandwich-type blister card is provided to contain a product item such as a pliers or scissors with a handle extending outside of the blister. The blister card includes a back panel, a front panel, and a blister having a blister cavity and a peripheral flange. The blister includes a wrap-around strap attached to the blister at a first end of the strap to secure a portion of the product therein. The peripheral flange and a second end of the strap are sealed between the front and back panels.

9 Claims, 8 Drawing Sheets

(56) References Cited

U.S. PATENT DOCUMENTS

| | | | | |
|---|---|---|---|---|
| 5,291,996 | A * | 3/1994 | Linden | B65D 73/005 206/349 |
| 5,435,447 | A * | 7/1995 | Weatherford | B65D 75/22 206/349 |
| 5,542,539 | A | 8/1996 | Early | |
| 5,601,189 | A * | 2/1997 | Roshdy | A61B 50/30 206/363 |
| 6,814,236 | B2 * | 11/2004 | Roshdy | A61B 50/33 206/363 |
| 7,789,234 | B2 * | 9/2010 | Clark | B65D 73/0014 206/349 |
| 8,251,214 | B2 * | 8/2012 | Wade | B65D 73/0092 206/459.5 |
| 8,800,768 | B2 * | 8/2014 | Corbat | B65D 75/322 206/463 |
| 2009/0065386 | A1 * | 3/2009 | Hasegawa | A47F 5/0006 206/349 |
| 2013/0319896 | A1 | 12/2013 | Corbat et al. | |

* cited by examiner

FIG. 6A
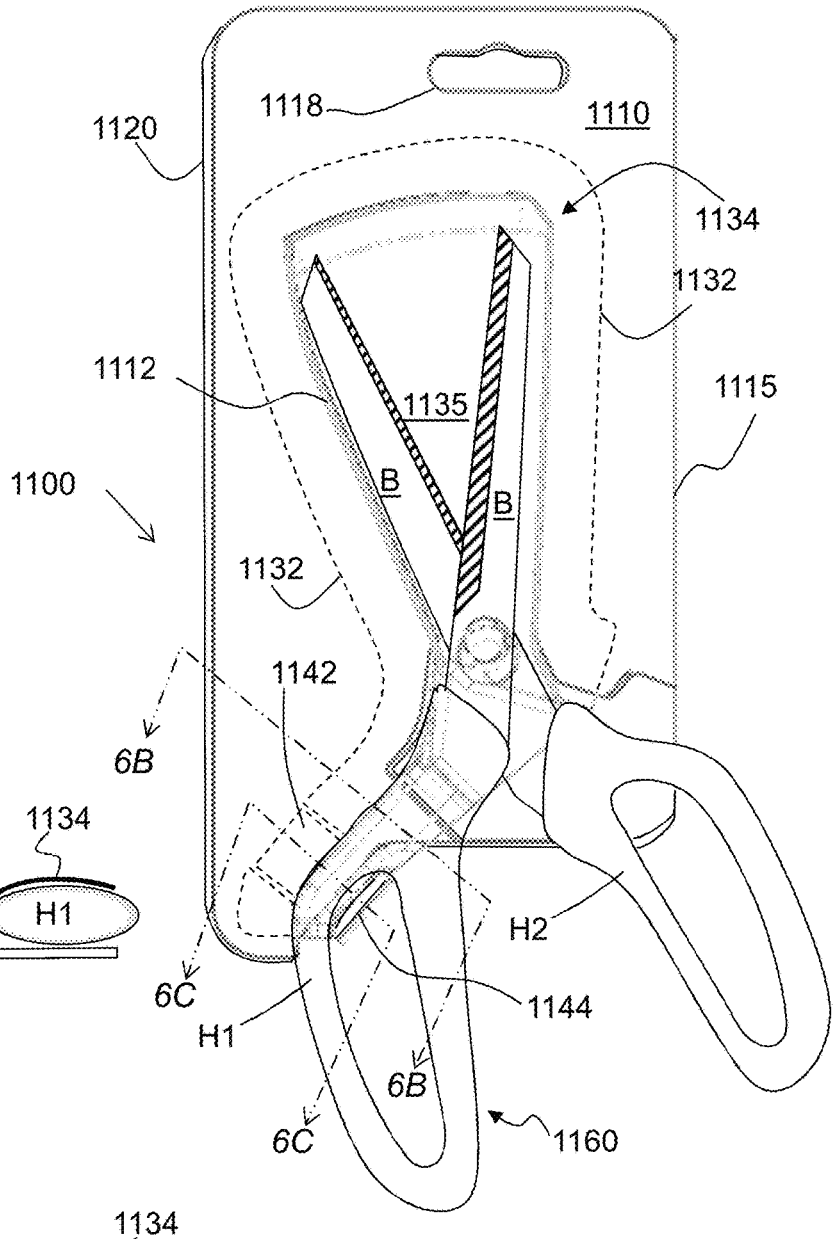
FIG. 6B
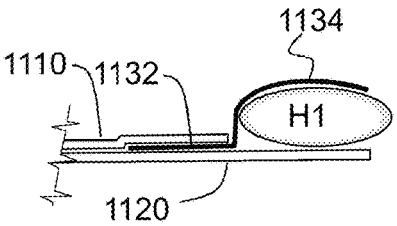
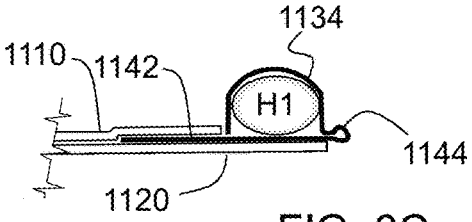
FIG. 6C

BLISTER CARD WITH FLANGE STRAP

REFERENCE TO RELATED APPLICATION

This application claims the benefit of priority under 35 U.S.C. § 119(e) of U.S. provisional application Ser. No. 62/100,587, filed on Jan. 7, 2015, which is hereby incorporated by reference in its entirety.

BACKGROUND

The present application is directed to blister cards, and more particularly, to sandwich-type blister cards where the blister contains an item such as a tool with a part such as a handle extending outside the blister. The blister may have a flange, a portion of which may be wrapped around the handle.

Merchandise items are often packaged on blister-type display cards. Such display cards may include a plastic blister to hold the product, and a printed paperboard card describing the product. The blister may be attached to the card, or may enclose the card. When tools are packaged in such display cards, it may be desired to have a portion of the tool exposed. This may be especially true with tools such as pliers, scissors, and the like where a handle may be left outside the blister so that a prospective purchaser may move the handle and observe the action of the tool. U.S. Pat. No. 4,165,805 to Fethke discloses a scissors housed in a blister attached to the front of a single card, with one of the scissors handles outside the blister. U.S. Pat. No. 4,872,551 to Theros discloses a clamshell blister that wraps around a card and pliers, with the handles of the pliers extending outside the clamshell blister at the bottom of the package. U.S. Pat. No. 5,279,417 to Seaton discloses a clamshell blister that wraps around a pair of gardening shears, with one handle extending sideways outside of the blister.

The present invention involves a blister whose perimeter flange is sandwiched between two cards, with one or more openings in the blister through which part or parts of the product (such as handles) may extend. A portion of the blister flange may wrap around a part of the product (such as the handle.

SUMMARY

In one aspect a blister card is disclosed for holding a content item, the blister card including a front panel with a window therein created by at least partly separating a cutaway portion from the front panel; a back panel attached to the front panel; a blister including a blister cavity and a peripheral flange, the blister cavity protruding through the window and the peripheral flange received between the front and back panels; wherein the cutaway portion is positioned between the blister and the back panel; and wherein an opening is formed in the blister cavity through which a portion of the content item may protrude. Additionally a portion of the blister flange, in the area of the opening in the blister cavity, is wrapped around the protruding portion of the content item.

In another aspect, a method is disclosed for making a blister card holding a content item, the method including providing a front panel with a window therein defined by a cutline, and a back panel hingedly attached to a lower edge of the front panel; separating the cutaway portion from the front panel leaving a window in the front panel, and placing the cutaway portion onto the back panel in mirror registry with the window; placing into the window a blister having a cavity sized to receive at least part of the content item, the blister having a peripheral flange and a side wall, the side wall having a first opening and a second opening; inserting a content item into the blister card by threading a first portion of the content item through the first opening, with a second portion of the content item being received in the blister cavity and a third portion of the content items extending through the second opening; folding the back panel over upon the front panel, with the peripheral flange between the panels; sealing together the front and back panels around their periphery; sealing together the front and back panels just outside the cutaway portion; and sealing together the back panel and the cutaway portion where the cutaway portion extends beyond the blister. Additionally a strap portion of the blister flange, in the area of the opening in the blister cavity, is wrapped around the protruding portion of the content item and the end of the strap is sealed between the panels, in a gap provided in the flange.

Other aspects of the disclosed packaging structures will become apparent from the following description and the accompanying drawings.

BRIEF DESCRIPTION OF THE DRAWINGS

The attached Figures show blister cards including a blister sandwiched between a pair of cards.

FIG. 6A repeats drawing of FIG. 4, with the product now shown within the blister;

FIGS. 6B-6C show cross sections of certain details in FIG. 6A;

DETAILED DESCRIPTION

Figure 1A:
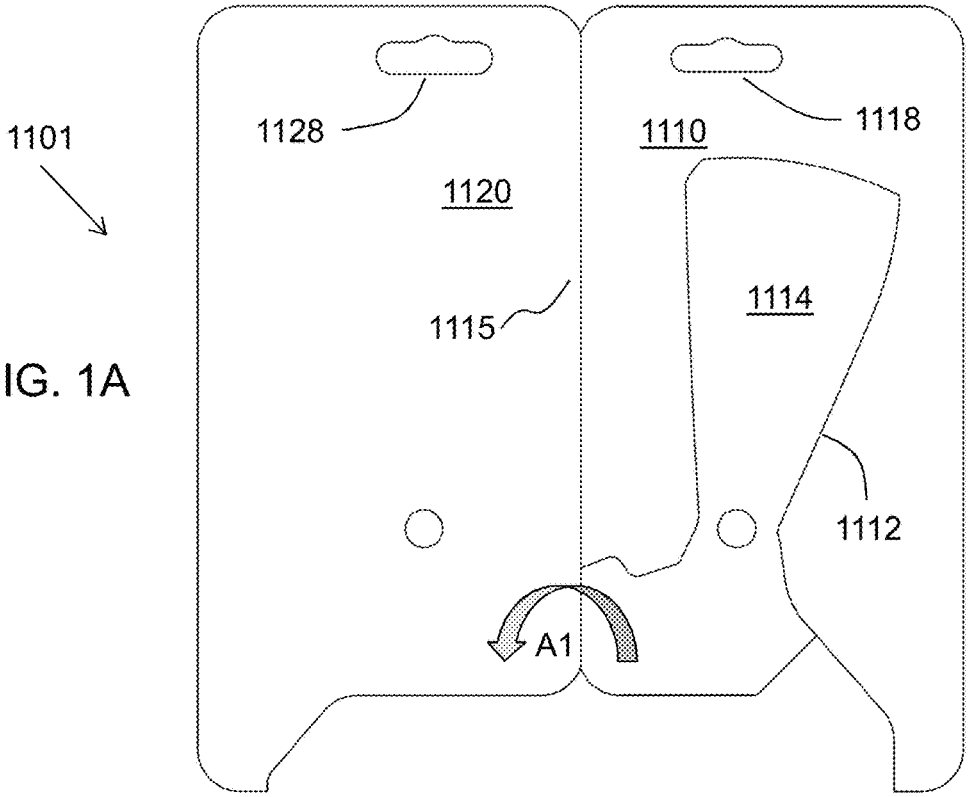
FIG. 1A shows a plan view of a blank for making a front panel and back panel for a blister package.

As various embodiments of the blister card are described, reference will be made to the attached Figures. Certain parts of the blister cards are denoted by reference numerals. Where there is more than one of the same feature, sometimes only one will be denoted by a reference numeral. Where assembly steps are described, these steps are exemplary and are not to be limiting as to the sequence of operations used to arrive at the final blister card. Also, directions such as up, down, top, bottom, front, back, etc. are used for convenience in describing the structure and are not meant to be limiting. In most cases the blister cards described here are made from one or several blanks (that is, the cut sheet parts from which the blister cards are made by folding and other steps). However, it should be understood that certain unitary blanks may be provided instead as more than one part, and certain blanks may be combined into single blanks, while still arriving at the same finished package.

FIG. 1A shows a plan view of a blank 1101 for making a blister card 1100. The blank may include a front panel 1110 with a back panel 1120 hingedly attached through a fold line 1115 between the side edges of the panels. The front and back panels 1110, 1120 may each include a hang hole 1118, 1128. An opening 1112 may be provided in the front panel 1110. The opening or window 1112 may define a cutaway section 1114 (sometimes called 'window waste') in front panel 1110.

Figure 1B:
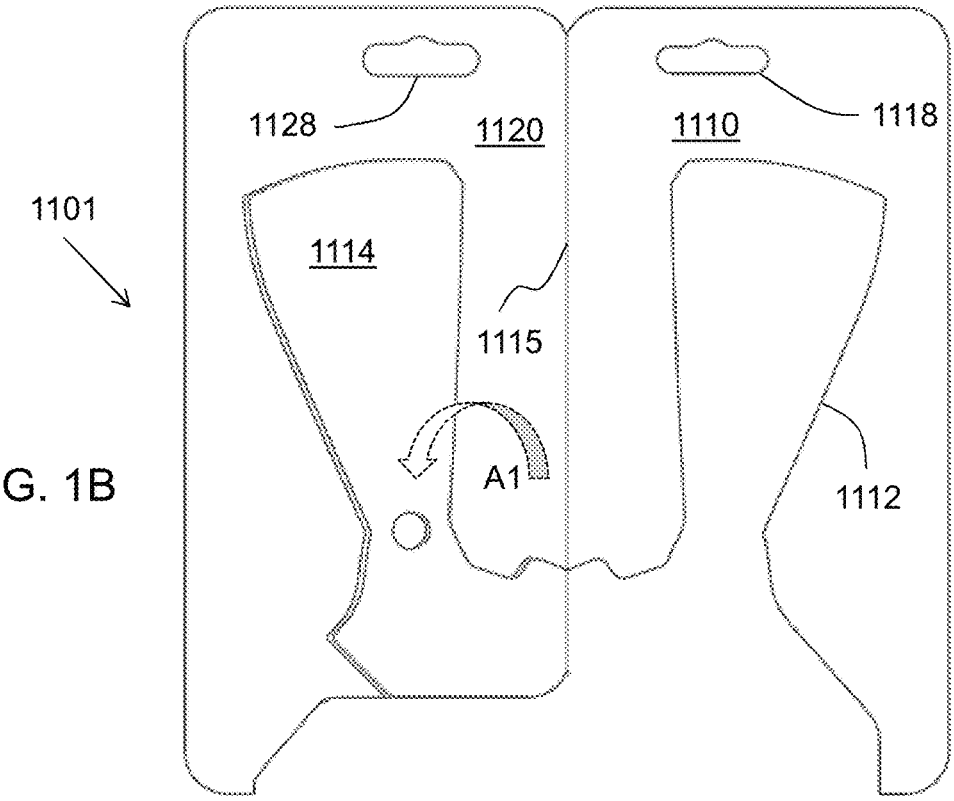
FIG. 1B shows a plan view of the blank after moving a section of material from the front panel to the back panel, leaving an opening in the front panel.

The cutaway section 1114 may be flipped over and transferred (as per arrow A1) onto the back panel 1120 into a mirrored position (FIG. 1B) that will (after folding the panels along fold line 1115) bring the cutaway 1114 back into register with window 1112. Cutaway 1114 may be temporarily held in place by a small amount of glue or other suitable method.

Figure 2A:
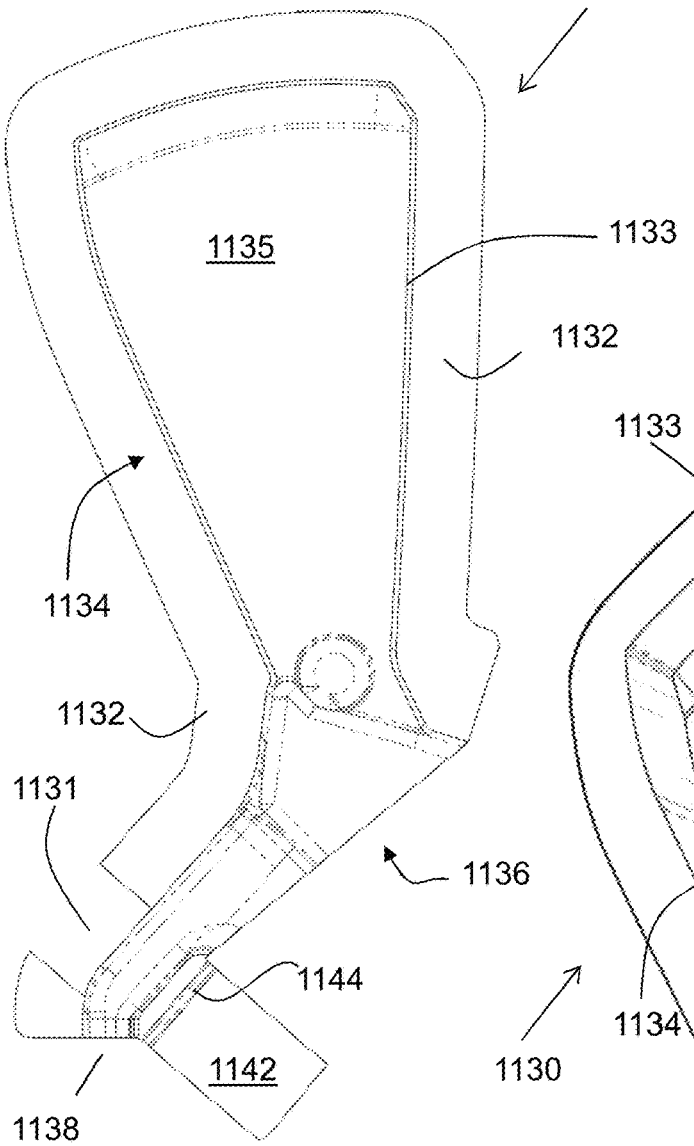
FIG. 2A shows a plan view of a blister to be used with the blank of FIGS. 1A and 1B.
Figure 2B:
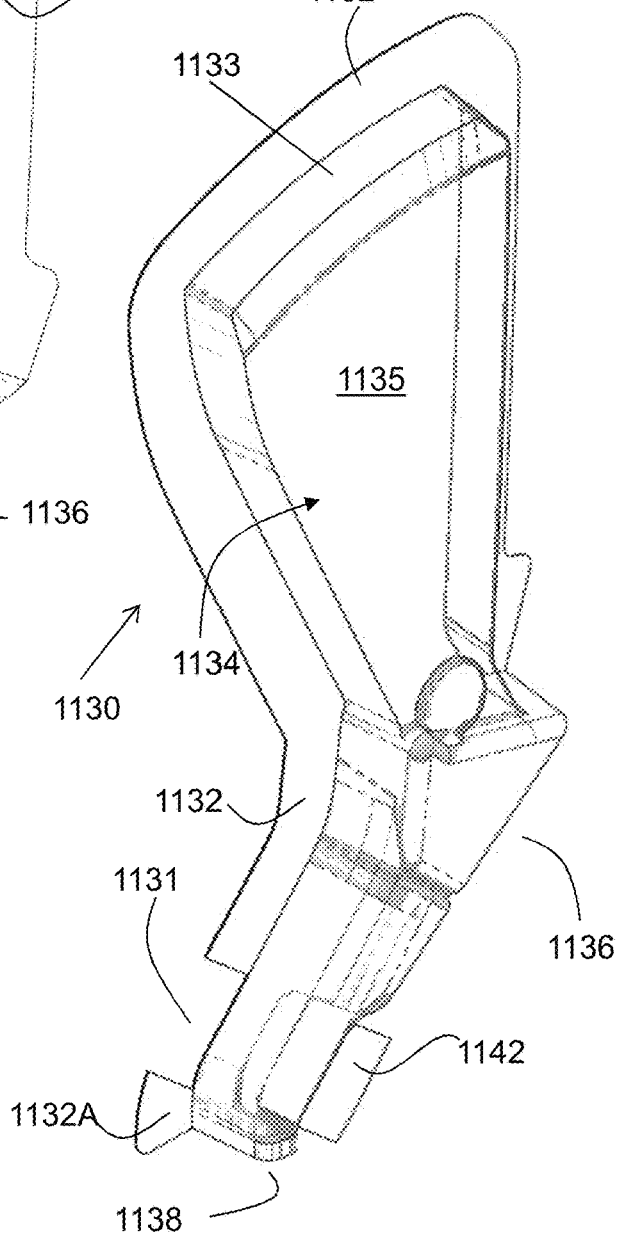
FIG. 2B shows a perspective view of the blister of FIG. 2A.
Figure 5:
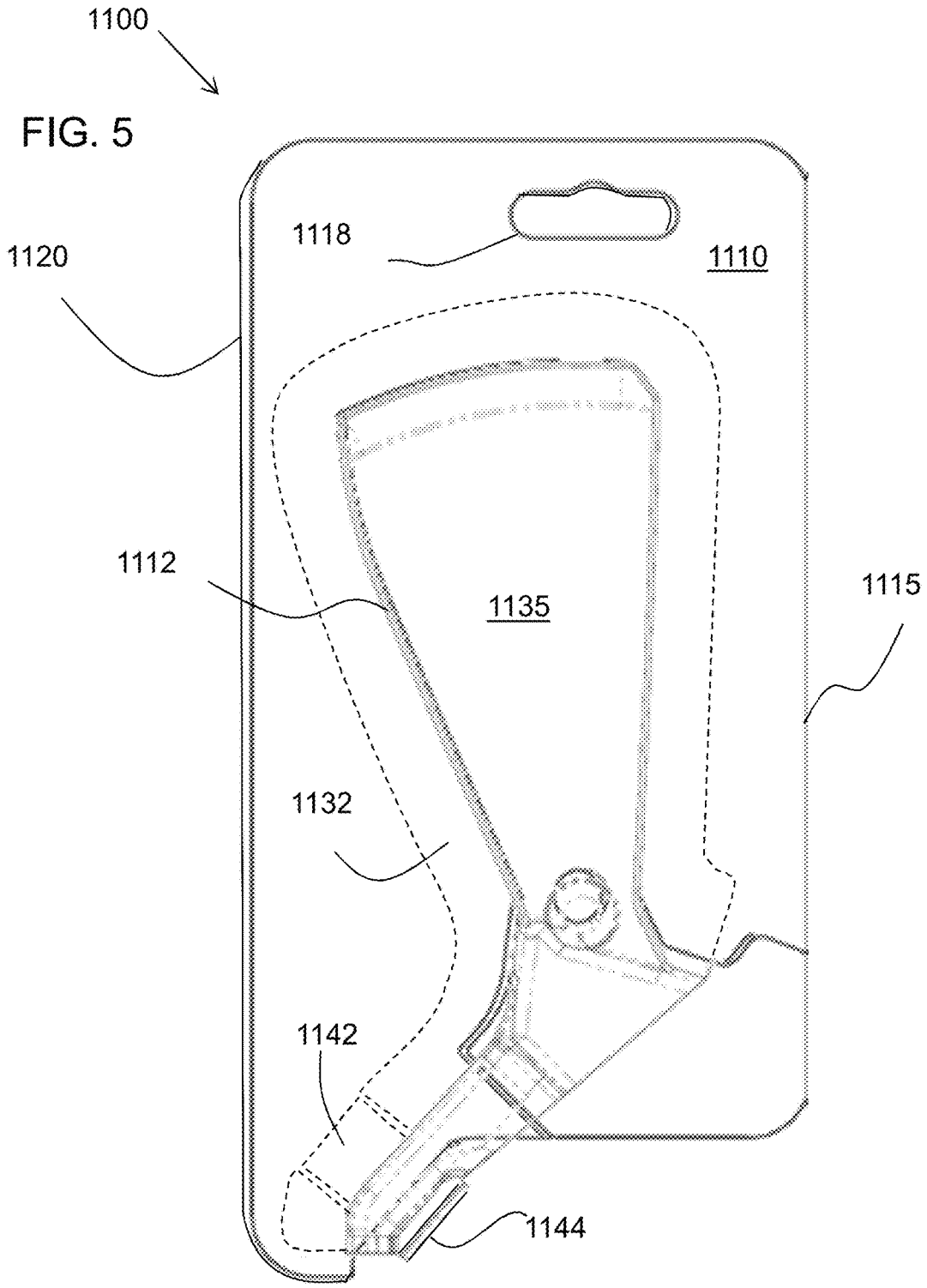
FIG. 5 shows the finished blister card (not yet showing the product that is actually held within)

FIG. 2A shows a blister 1130 in plan view, and FIG. 2B shows the blister in perspective view. Blister 1130 may include a blister cavity 1134 with a face 1135 and a wall 1133. The blister may have a peripheral flange 1132 extending partway around the blister. A first blister opening 1136 may be provided (e.g. in blister wall 1133) for a movable part of a content item, such as a first handle H1 of a tool T (see FIG. 5), to be housed in blister 1130. A second blister opening 1138 may be provided for a stationary part of the content item, such as a second handle H2 of the tool. The blister face 1135 may have an opening (not shown) to allow a prospective customer to touch a content item. However, for certain content items such as those having a sharp edge or a pinching action, it may be preferable not to have openings in the blister face 1135.

The blister flange 1132 may have a gap 1131 to receive a fold-around strap 1142 whose proximal portion may be attached to the blister at a strap fold or strap hinge 1144. The fold-around strap 1142 may be folded or wrapped around a part of the content item T, such as handle H1. The distal end of fold-around strap 1142 may be received into gap 1131. (Gap 1131 may also be omitted, but having the gap 1131 leaves the 'flange' area to have a single thickness at the gap 1131, which otherwise would be a double thickness of flange that might be more difficult so securely seal. A portion 1132A of the blister flange 1132 may continue after the gap 1131 (as shown in FIGS. 2A-2B), or the gap may be at an end of blister flange 1132 with portion 1132A omitted. Thus the term 'flange gap' may be interpreted as an area where the flange 1132 does not extend, either being a discontinuity in the flange or an area just beyond the end of the flange, or another area where there is no flange.

Figure 3A:
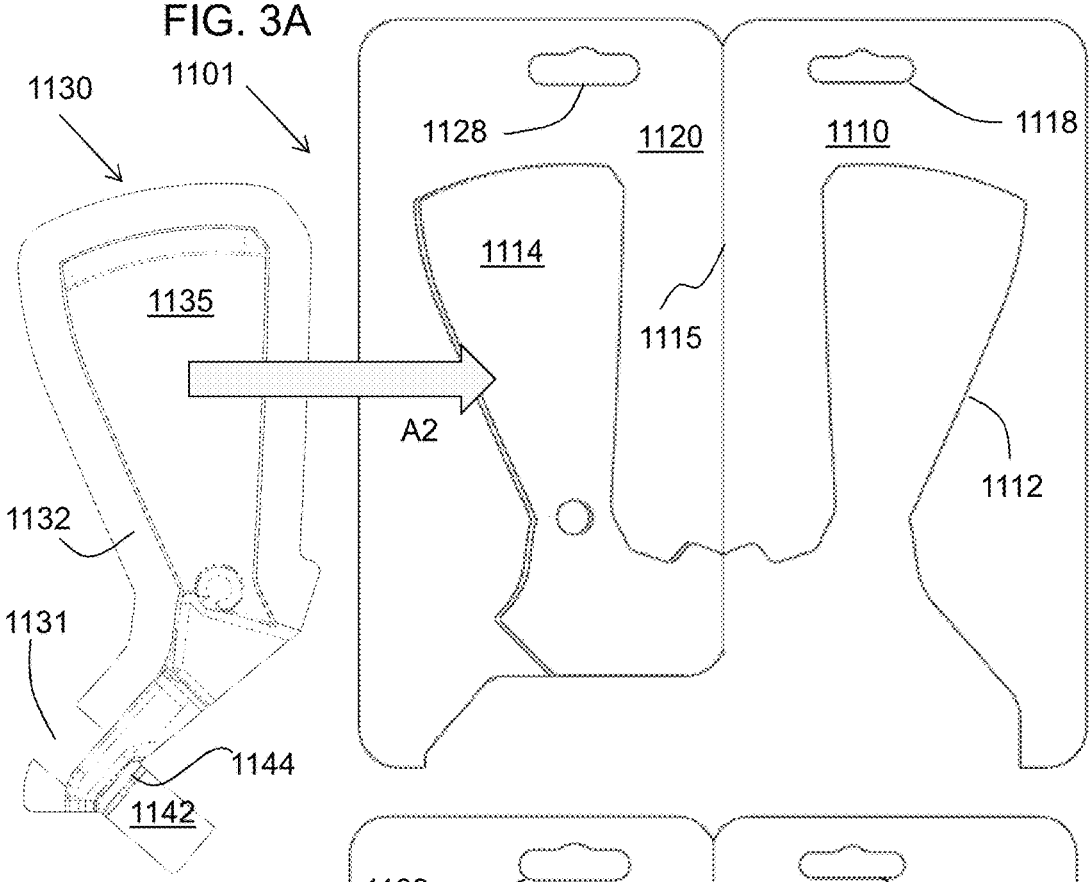
FIG. 3A shows the blister of FIG. 2A being placed onto the back panel and section of material of FIG. 1B.
Figure 3B:
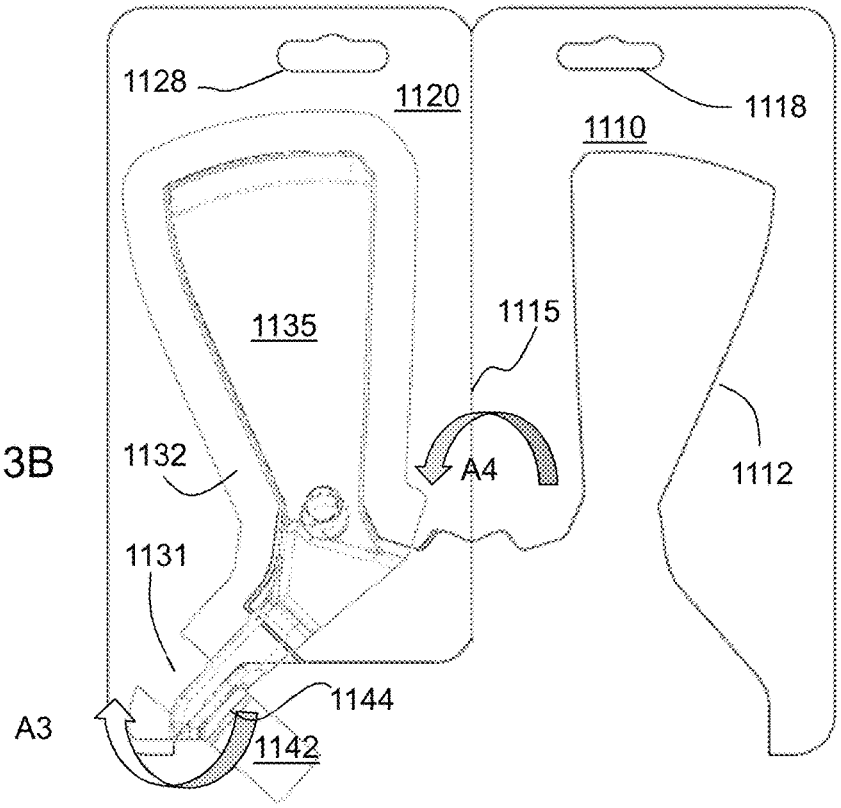
FIG. 3B shows how a strap portion of the blister flange may be wrapped under a product (not shown) received in the blister, and the front card folded over onto the back card and blister.
Figure 4A:
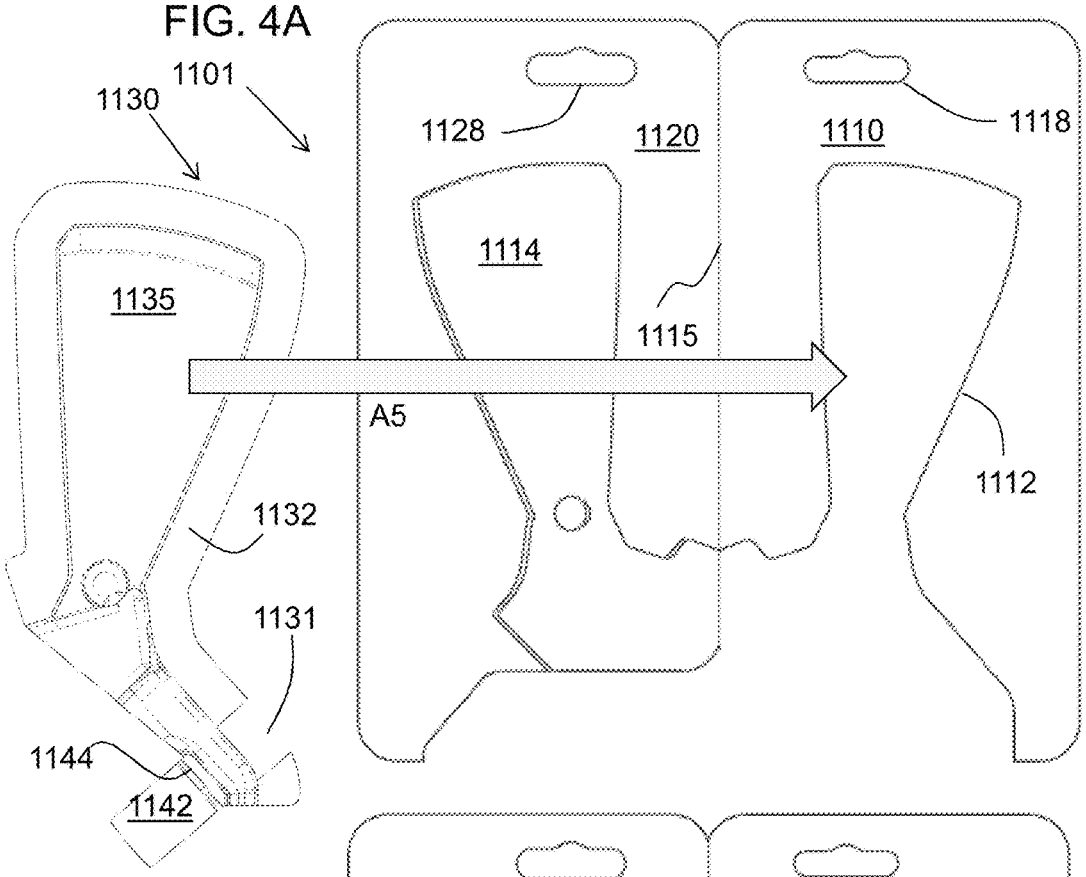
FIG. 4A shows the blister of FIG. 2A being placed into the opening in the front panel of FIG. 1B.

FIG. 3-7 illustrate example assembly steps for the blister card, as seen from the starting from an 'inside' view of the blank 1101 in FIG. 3A or FIG. 4A.

One assembly method is shown in FIG. 3A where blister 1130 is being positioned (as per arrow A2) over the back panel 1120 and cutaway 1114. The blister face 1135 is thus facing upward (toward the viewer) and the product contents would have been placed between the cutaway 1114 and the blister itself.

FIG. 3B shows the flange strap 1142 being folded (arrow A3) under the content item (not shown) so that the distal end of the flange strap 1142 may come into position at the flange gap 1131. Next, the front panel 1110 may be folded over (Arrow A4) along fold line 1115 and onto back panel 1110, with opening 1112 in front panel 1110 coming into alignment around the upward facing cavity of the blister. This will result in the assembled card 1100 shown in FIG. 5.

Another assembly method is shown in FIG. 4A where blister 1130 is being positioned (as per arrow A5) so as to drop the cavity and blister face 1135 through the opening 1112 in front panel 1110. The product contents (not shown) can then be placed into the blister cavity.

Figure 4B:
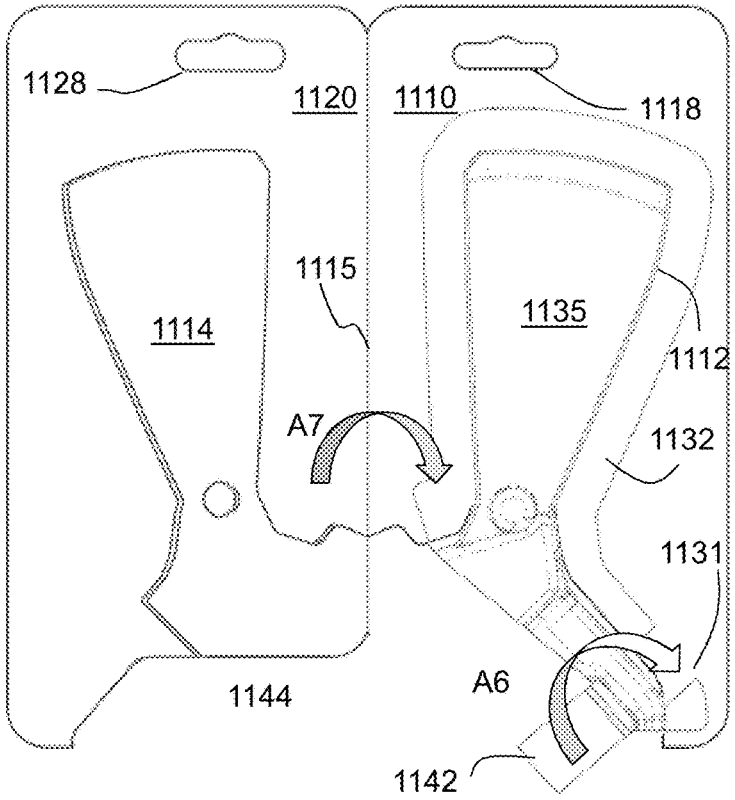
FIG. 4B shows how a strap portion of the blister flange may be wrapped over a product received in the blister, and the back card folded over onto the front card and blister.

FIG. 4B shows the flange strap 1142 being folded (arrow A6) over and around the content item (not shown) so that the distal end of the flange strap 1142 may come into position in the flange gap 1131. Next, the back panel 1120 and cutaway 1114 may be folded over (Arrow A7) along fold line 1115 and onto front panel 1110. When this finished structure is flipped over sideways, it will be the assembled card 1100 shown in FIG. 5.

FIG. 6A shows a tool 1160 housed in blister card 1100. The blister face 1135 faces upward, with the blister cavity 1134 holding part of the tool 1160, for example blades B within the cavity. Handles H1 and H2 are at least partly exposed, which allows a prospective customer to handle and even operate tool 1160. The blister card may be designed as shown to leave the handles relatively unobstructed by the card. This may leave little or no room to seal blister flange 1132 at the lower end of blister card 1100. To help secure tool 1160, the flange strap 1142 may be wrapped around the handle H1 and placed in the flange gap 1131 where it may be sealed (along with the rest of flange 1132) between the front panel 1110 and back panel 1120.

The cross section view of FIG. 6B shows a part of handle H1 partially enclosed in blister cavity 1134, with the blister flange 1132 sandwiched between front panel 1110 and back panel 1120. The cross section view of FIG. 6C shows another part of handle H1 located in blister cavity 1134, with the flange strap 1142 wrapping handle H1 and the distal end of flange strap 1142 sandwiched between front panel 1110 and back panel 1120, in the space provided by flange gap 1131. The proximal portion of the flange strap 1142 may be attached to the blister at a strap fold or strap hinge 1144, which may have a different shape or cross section than shown in FIG. 6C.

Figure 7:
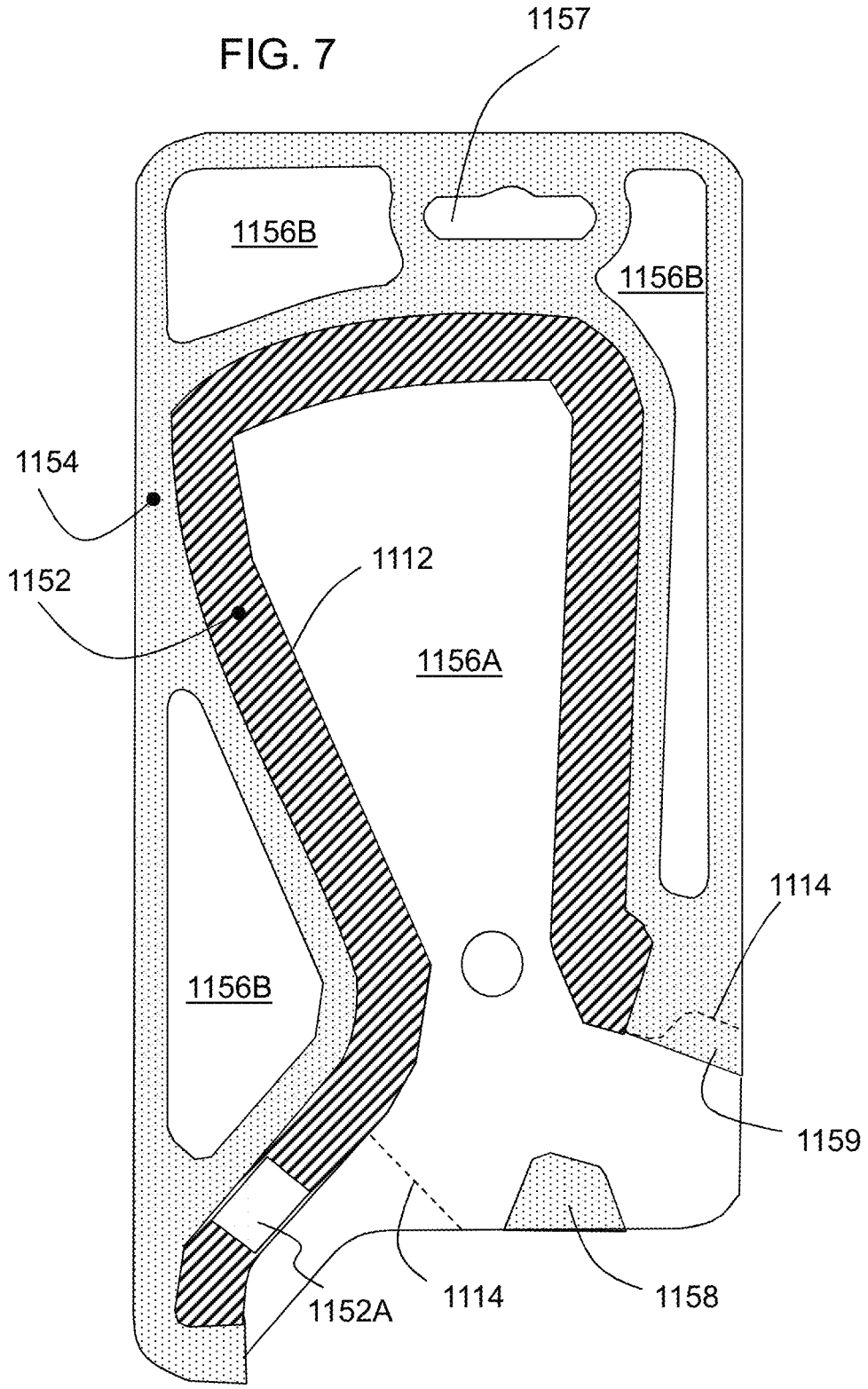
FIG. 7 shows an example seal pattern for the blister card of FIG. 6A.

FIG. 7 show a plan view of a seal pattern for sealing the front panel 1110 and back panel 1120 with the blister flange 1132 between the panels. Unshaded portions of the Figure may be left unsealed, such as area 1156A generally bounded by opening 1112 in front panel 1110, and generally corresponding to the location of the blister cavity 1134. Certain other areas such as 1156B may be left unsealed, for example to reduce pressing force on the sealing tool, or reduce energy if heat sealing is used. Area 1157 corresponding to hang holes 1118, 1128 needs no sealing. The cross-hatched area 1152 adjacent the opening 1112 represents an area where a panel-flange-panel seal may be achieved including front panel 1110, blister flange 1132, and back panel 1120. This panel-flange-panel seal area includes subarea 1152A where the distal end of strap 1142 may be secured.

The lightly shaded areas 1154 of FIG. 7 represent areas where a panel-panel seal may be achieved between front panel 1110 and back panel 1120. This panel-panel seal area may include subareas 1158 and 1159 where the cutaway 1114 may be sealed to back panel 1120. Otherwise much of the cutaway may be left unsealed since the blister and/or tool T would interfere with the seal pattern. (The boundaries of the cutaway correspond to the dashed lines shown in FIG. 7 and also much of the opening 1112).

The size, position, and shape of the window, the blister, and the blister opening or openings for the handle(s) may be set according to manufacturing preference.

Figure 8A:
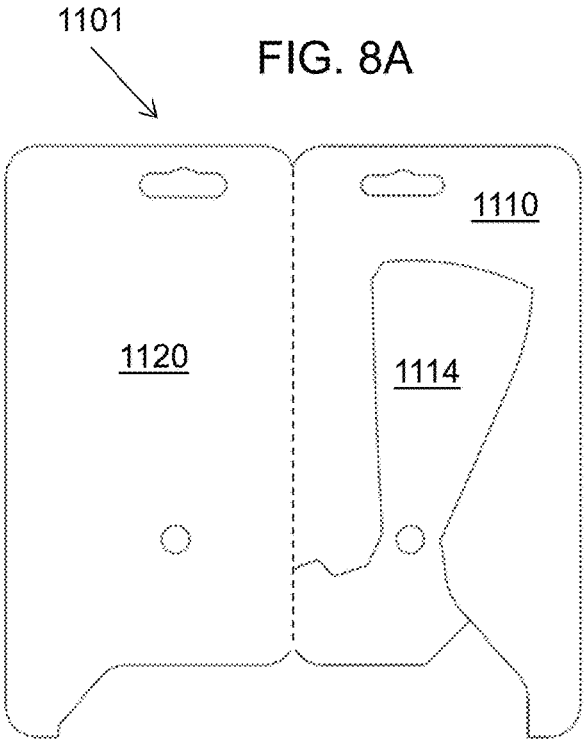
FIGS. 8A-8C show plan views of example blank patterns.
Figure 8B:
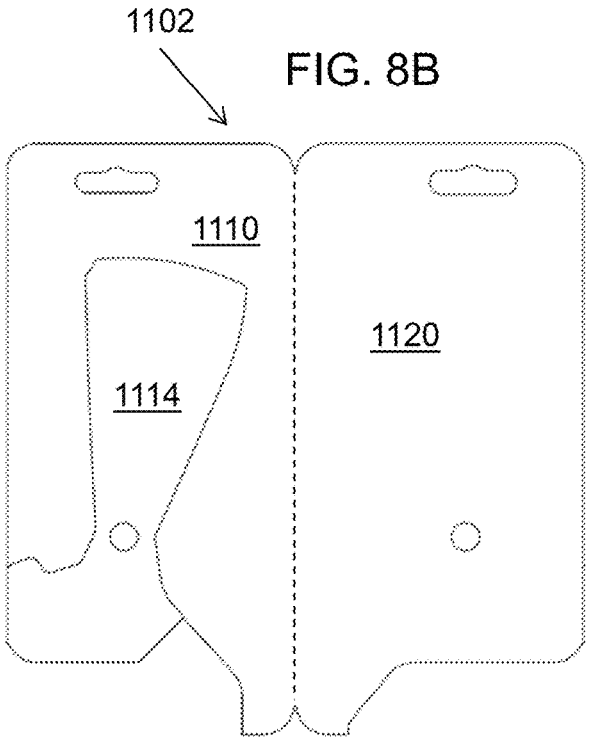
Figure 8C:
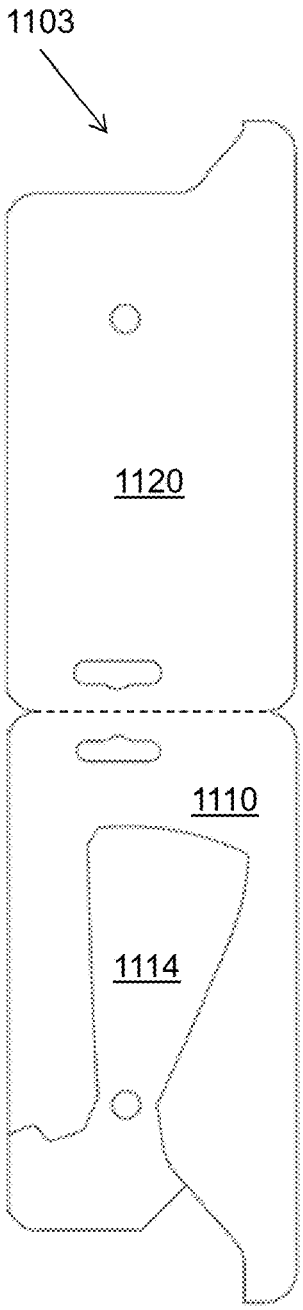

FIGS. 8A-8C show several example blanks. FIG. 7A shows blank 1101, as already described, where the front panel 1110 and its cutaway 1114 are hinged to back panel 1120 along a side edge of the blister card. This particular blank or similar blanks may be advantageous since the cutaway 1114 is left hinged to the structure. FIG. 7B shows another blank 1102, where the front panel 1110 is hinged to back panel 1120 along an opposite side edge of the blister card. FIG. 7C shows another blank 1103, where the front panel 1110 is hinged to back panel 1120 along a top edge of the blister card.

Although the blanks may typically originate as single pieces, as shown, they may also be provided as multiple pieces. The blanks may be made of a sheet material such as paperboard, or of a tear-resistant paperboard such as Mead-Westvaco NATRALOCK®.

Blister 1130 may be made with common thermoform plastics such as PVC or APET but may also include a recycled material such as RPET or a biodegradable material such as PLA. However other materials including other plastics or paperboard may also be used. Besides thermoforming, the case or blister may be formed by injection molding or other manufacturing methods.

One blank may be used, as shown in the examples, or more than one blank may be used. Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

Portions of the blister cards may be made of one, two, or more layers of material. It is to be understood that additional layers of material may be used based on manufacturing preferences. Portions of certain panels may be folded over or around the portions of other panels, creating multiple layers of material.

The invention claimed is:

1. A blister card for holding a content item, the blister card comprising:

a front panel with a window therein created by at least partly separating a cutaway portion from the front panel;

a back panel attached to the front panel;

a blister comprising a blister cavity and a peripheral flange, the blister cavity protruding through the window and the peripheral flange received between the front and back panels;

the blister further comprising a strap attached to the blister at a first end of the strap; and wherein the peripheral flange and a second end of the strap are sealed between the front and back panels;

wherein the second end of the strap is received into a gap in the peripheral flange; wherein the second end of the strap has a first thickness and the peripheral flange has a second thickness, wherein the first thickness is the same as the second thickness, and wherein the second end of the strap is coplanar with a plane defined by the peripheral flange.

2. The blister card of claim 1, further comprising a content item, wherein the strap is wrapped around a portion of the content item.

3. The blister card of claim 1, wherein the cutaway portion is positioned between the blister and the back panel.

4. The blister card of claim 3, wherein the cutaway portion is in register with the window.

5. The blister card of claim 3, wherein the blister cavity receives an upper portion of the content item, while a lower portion or portions of the content item extend below the blister card.

6. The blister card of claim 1, wherein the front panel and back panel are fastened together by adhesive.

7. The blister card of claim 1, wherein the front panel and back panel are fastened together by heat sealing.

8. The blister card of claim 1, wherein the front panel and back panel are hingedly joined along a side edge of the panels.

9. The blister card of claim 8, wherein the cutaway portion is hingedly joined to the back panel along the side edge of the back panel.

* * * * *